US007891443B2

(12) United States Patent
Massey et al.

(10) Patent No.: US 7,891,443 B2
(45) Date of Patent: Feb. 22, 2011

(54) HARDFACING AROUND BALL LOADING HOLE FOR EARTH-BORING BIT

(75) Inventors: Alan J. Massey, Houston, TX (US); David K. 'Keith' Luce, Splendora, TX (US); Keith L. Nehring, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 328 days.

(21) Appl. No.: 12/032,334

(22) Filed: Feb. 15, 2008

(65) Prior Publication Data

US 2008/0202817 A1 Aug. 28, 2008

Related U.S. Application Data

(60) Provisional application No. 60/902,690, filed on Feb. 22, 2007.

(51) Int. Cl.
*E21B 10/46* (2006.01)

(52) U.S. Cl. ..... 175/374; 175/375

(58) Field of Classification Search ..... 175/339, 175/374, 375

See application file for complete search history.

(56) References Cited

U.S. PATENT DOCUMENTS

| | | | | |
|---|---|---|---|---|
| 3,158,214 | A | 11/1964 | Wisler et al. | |
| 4,781,770 | A * | 11/1988 | Kar | 148/220 |
| 5,547,033 | A | 8/1996 | Campos, Jr. | |
| 5,553,681 | A * | 9/1996 | Huffstutler et al. | 175/339 |
| 5,755,297 | A | 5/1998 | Young et al. | |
| 5,755,299 | A * | 5/1998 | Langford et al. | 175/375 |
| 7,182,162 | B2 | 2/2007 | Beuershausen et al. | |
| 7,484,577 | B2 * | 2/2009 | Overstreet et al. | 175/374 |
| 2006/0021800 | A1 * | 2/2006 | Beuershausen et al. | 175/374 |
| 2009/0044984 | A1 * | 2/2009 | Massey et al. | 175/374 |

FOREIGN PATENT DOCUMENTS

| | | |
|---|---|---|
| WO | WO 99/39075 | 8/1999 |

* cited by examiner

*Primary Examiner*—Daniel P Stephenson
(74) *Attorney, Agent, or Firm*—Bracewell & Giuliani LLP

(57) ABSTRACT

A rotary cone earth boring bit has at least one bit leg with a cone retaining ball passage that intersects an outer surface of the bit leg and is closed by a ball plug. An upwardly curved lower hardfacing bead is on the outer surface of the bit leg at least partially below the ball plug. A downwardly curved upper hardfacing bead is on the outer surface of the bit leg at least partially above the ball plug. The upper hardfacing bead has leading and trailing ends that join the lower hardfacing bead. The upper and lower hardfacing beads define a generally elliptical perimeter surround the ball plug. At least one transverse bead is above the upper hardfacing bead and leads generally upwardly and circumferentially from a leading edge of the bit leg to a trailing edge of the bit leg.

16 Claims, 3 Drawing Sheets

HARDFACING AROUND BALL LOADING HOLE FOR EARTH-BORING BIT

CROSS-REFERENCE TO RELATED APPLICATION

This application claims priority to provisional application 60/902,690, filed Feb. 22, 2007.

FIELD OF THE INVENTION

This invention relates in general to rolling cone earth-boring bits, and in particular to a hardfacing pattern surrounding the weld for a ball plug of a bit.

BACKGROUND OF THE INVENTION

A rotating cone drill bit has a body that is typically manufactured from three head sections welded to each other. Each head section has a bit leg with a depending bearing pin for supporting a rotating cone. As the bit turns, the cones rotate to disintegrate the earth formation.

Many bits retain the cones on the bearing pins by placing locking balls into mating grooves on the cone and the bearing pin. A ball passage extends through the bit leg from the grooves to the outer surface. The balls are inserted into an inlet of the ball passage, then a retainer plug is placed in the passage. The retainer plug is welded to the outer surface of the bit leg.

Hardfacing has been applied to portions of the drill bit for many years to resist abrasion. In the prior art, the hardfacing is normally applied to the teeth and gage surfaces of the cones. Also, hardfacing is normally applied to the shirttail of each bit leg. The shirttail is a curved lower end of each bit leg below the ball plug inlet. The hardfacing may also extend upward along one of the leading edges from the shirttail portion for a certain distance. Normally, hardfacing is not applied to the weld on the ball plug.

SUMMARY

In this invention, hardfacing is applied on the outer surface of the bit leg at least partially surrounding the inlet of the ball plug hole. A lower bead of the hardfacing curves below the ball plug inlet adjacent a shirttail of the bit leg. An upper bead of hardfacing curves at least partially around and above the ball plug. In the preferred embodiment, the leading and trailing ends of the upper bead join the lower bead, creating a generally elliptical perimeter of hardfacing around the ball plug inlet.

Also, one or more transverse beads of hardfacing extend from the leading edge to the trailing edge above the ball plug. The transverse bead is inclined relative to the axis of rotation of the bit. The leading end of the transverse bead joins the leading edge of the bit leg at a point lower than where the trailing end joins the trailing edge of the bit leg.

The central portion of the outer surface of the bit leg between the upper curved bead and the junction of the body with the bit leg is free of any hardfacing beads that are perpendicular to the axis of the bit. This central portion of the bit leg is more subject to stress due to weight on the bit. Stress cracks can occur at the edge of hardfacing beads. If the hardfacing beads in this area extended straight across perpendicular to the axis of rotation, any cracks might lead to breaking of the bit leg.

DETAILED DESCRIPTION OF THE INVENTION

Figure 1:
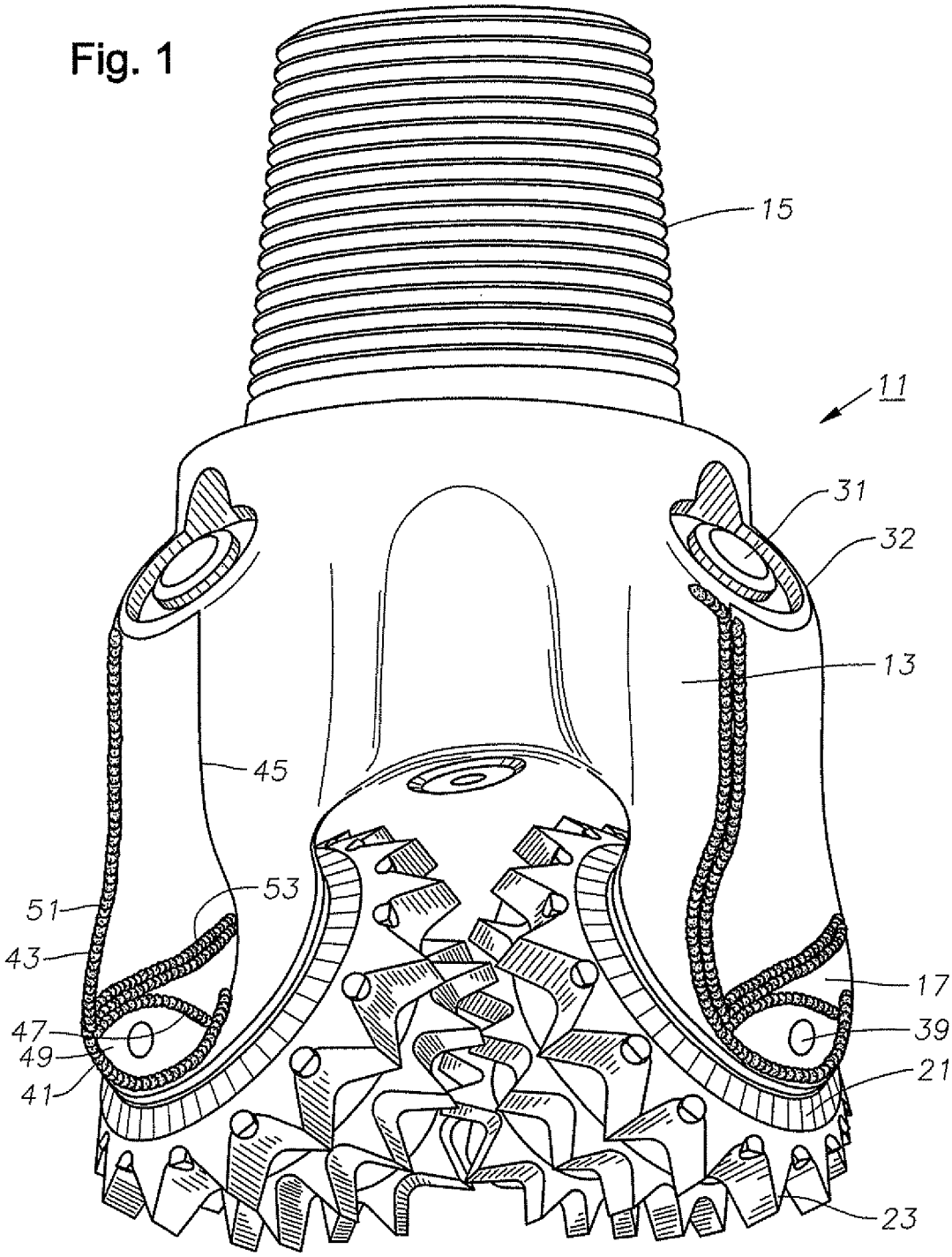
FIG. 1 is a front view of an earth-boring bit constructed in accordance with this invention.

Referring to FIG. 1, earth-boring bit 11 has a body made up of three head sections 13 that are welded to each other. The upper extents of each head section 13 form a generally conical stem. Threads 15 are cut on the stem for attachment to a drill string.

Figure 4:
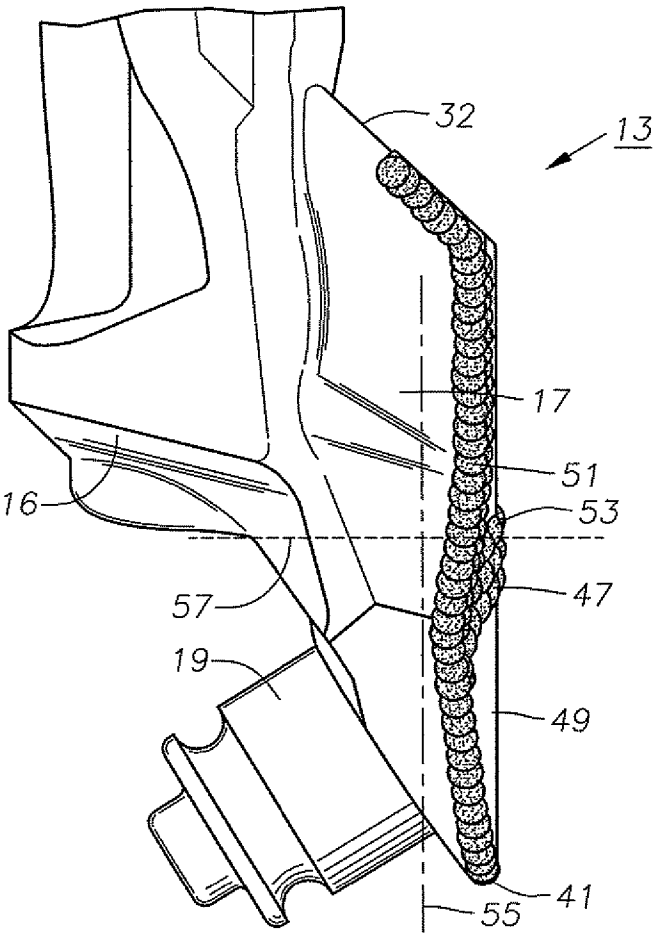
FIG. 4 is a side view of the leading side of the head section of FIG. 3.

Referring to FIG. 4, one of the head sections 13 is shown prior to welding to the other head sections. Each head section 13 has an upper body portion 16, best shown in FIG. 4, that is welded to upper body portions of other head sections 13. A bit leg 17 forms an outer portion of head section 13 and has a lower portion that depends downward from body section 16. The thickness of the lower portion of bit leg 17 as viewed in FIG. 4 decreases in a downward direction. A bearing pin or shaft 19 is integrally formed with each bit leg 17 and extends downward and inward.

Figure 2:
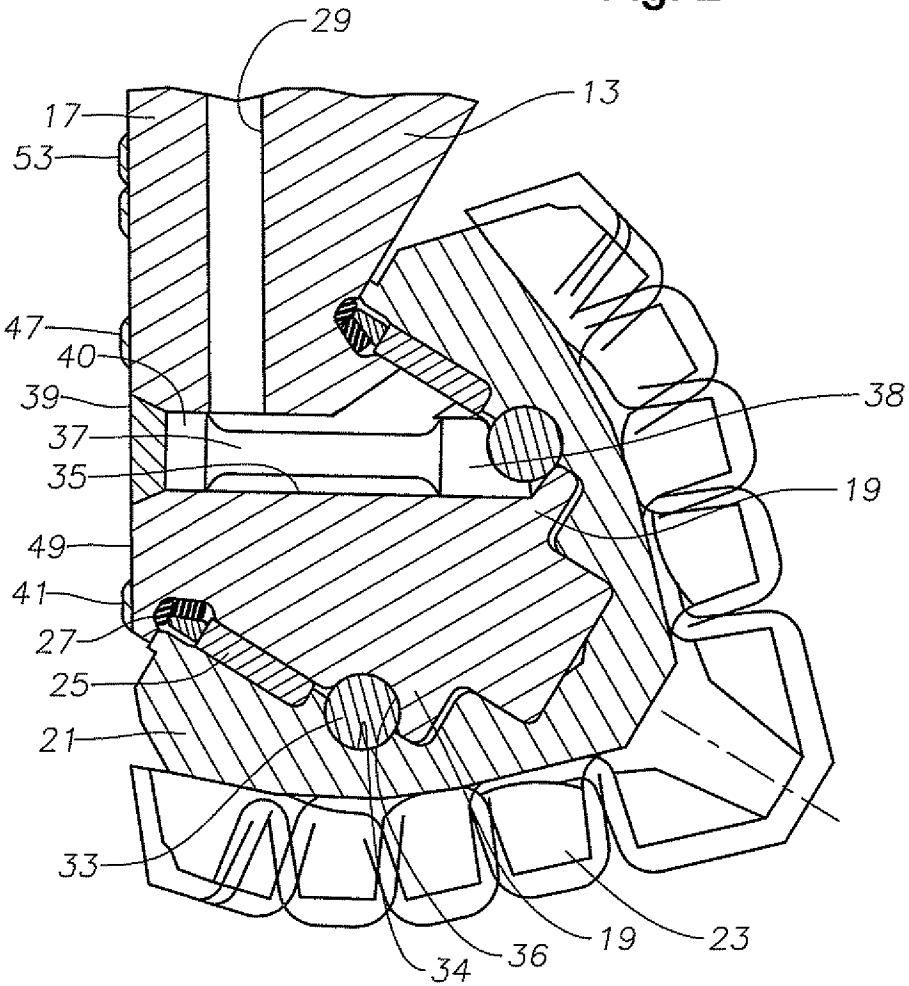
FIG. 2 is a sectional view of a portion of one of the bit legs of the earth-boring bit of FIG. 1.

Referring to FIG. 2, a cone 21 is rotatably mounted to each bearing shaft 19. Cone 21 has a plurality of cutting elements 23 on its exterior, which may be teeth milled into the support metal of cone 21, as shown. Alternatively, cutting elements 23 could comprise hard inserts, such as tungsten carbide, installed within mating holes in cone 21.

Cone 21 has a bearing sleeve 25 in this example that is located in the central cavity of cone 21 and rotatably engages bearing shaft 19 to form a journal bearing. The journal bearing is filled with lubricant. A seal 27 at the mouth of the cone cavity seals the lubricant within the spaces between bearing shaft 19 and cone 21 and also prevents entry of debris and fluid from the well bore. The lubricant is supplied from a reservoir (not shown) via a lubricant passage 29 extending within each bit leg 17. A pressure compensator (not shown) equalizes the pressure of the lubricant within passage 29 with that of the exterior borehole fluid pressure. FIG. 1 shows the compensator cap 31 that forms a part of the pressure compensator and is located on a transition area 32 at the upper end of bit leg 17.

Referring back to FIG. 2, each cone 21 is mounted on its bearing shaft 19 before head sections 13 are welded to each other. Each cone 21 is held on its bearing shaft 19 in this embodiment by a plurality of locking or retaining balls 33. Balls 33 are located within an annular space that is defined by a groove 34 in the cavity of cone 21 and a mating groove 36 on the exterior of bearing shaft 19. Grooves 34, 36 are semicircular in cross-section to define a circular cross-section when cone 21 is inserted on bearing shaft 19 and grooves 34, 36 are aligned.

When grooves 34, 36 are aligned, balls 37 are inserted into a ball passage 35 that extends from the outer side of bit leg 17 inward to an upper side of bearing shaft 19 in registry with mating grooves 34, 36. After all the balls 33 have been placed in grooves 34, 36, the technician installs a ball plug 37 in passage 35. Ball plug 37 comprises a rod having an inner end 38 that is partially cylindrical to close off the intersection of passage 35 with mating grooves 34, 36. Ball plug 37 prevents balls 33 from rolling back out of mating grooves 34, 36 into ball passage 35. Ball plug 37 has an outer end 40 that in this embodiment is recessed within the entrance of ball passage 35 a short distance. A weld 39 is formed in the recessed area, thereby welding ball plug 40 to the body of bit leg 17.

Figure 3:
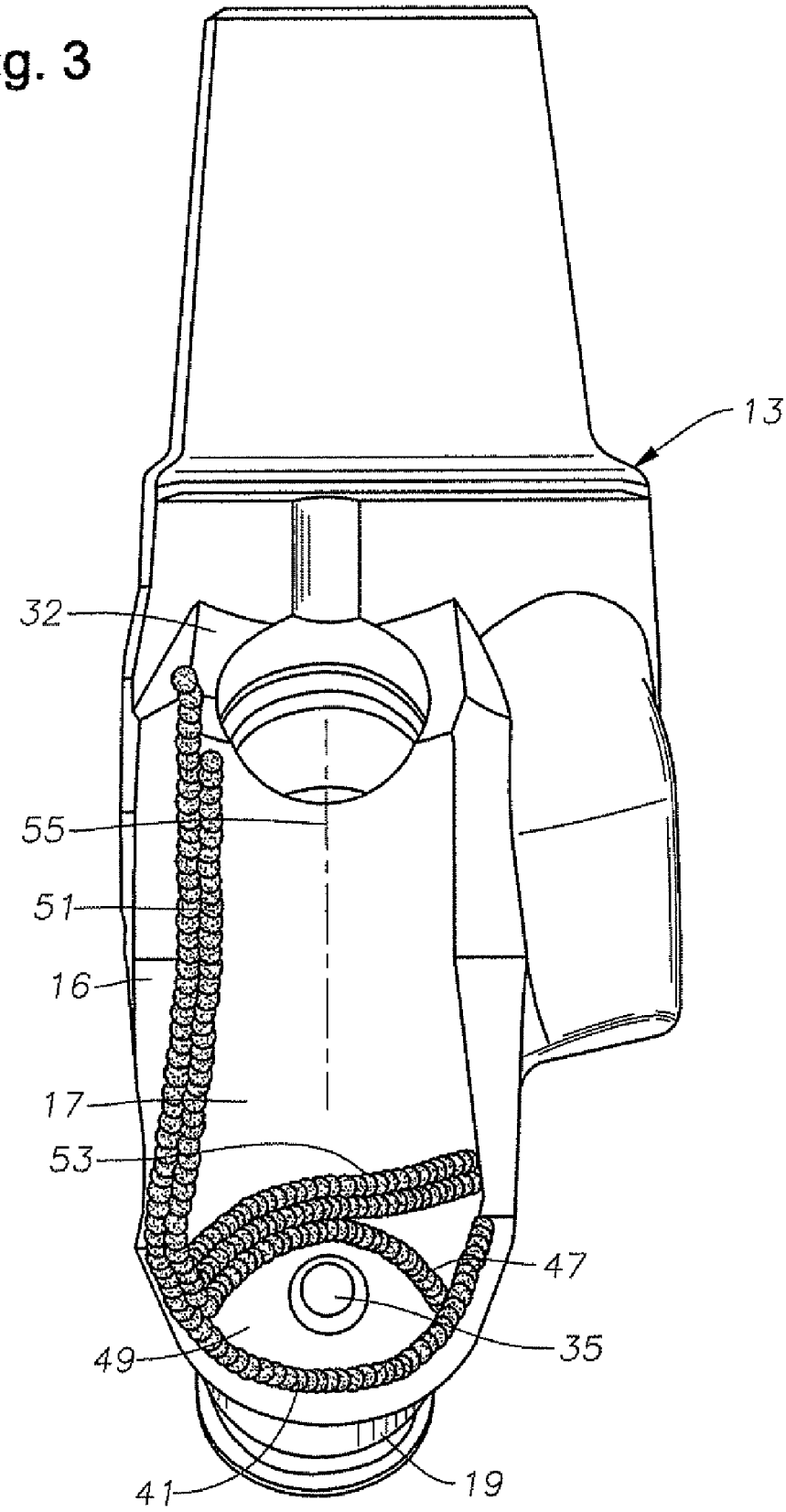
FIG. 3 is a front view of one of the head sections of the bit of FIG. 1, shown prior to assembly with the other head sections.

FIG. 3 is another view of one of the head sections 13 shown prior to welding to the other head sections and also prior to having its cone 21 (FIG. 2) installed. Normally, ball passage 35 will already be drilled within bit leg 17 and bearing shaft 19. At this point, preferably hardfacing is applied to various points on the outer surface of bit leg 17. Preferably the hardfacing on each bit leg 17 includes a lower arcuate or curved bead 41 that extends along the curved lower edge or shirttail of the outer side of bit leg 17. Bead 41 preferably extends from the leading edge 43 to the trailing edge 45 of bit leg 17. If desired, to thicken the width of lower arcuate bead 41, more than one pass may be employed, each pass being arcuate with its ends leading upward. Lower arcuate bead 41 is spaced below and from the inlet of ball passage 35 by a selected margin and curves partially around the inlet of ball passage 35.

One or more upper arcuate or curved beads 47 are also placed on the outer surface of bit leg 17 above and partially extending around the inlet of ball passage 35. Each upper arcuate bead 47 extends from leading edge 43 to trailing edge 45 and joins lower arcuate bead 41. Upper arcuate bead 47 is curved with its ends facing downward and in the embodiment shown, has approximately the same radius of curvature as lower arcuate bead 41. Lower and upper beads 41, 47 completely surround a zone 49 that is free of hardfacing. Zone 49 is generally elliptical in this embodiment, although it could be circular, if desired. The inlet of ball passage 35 is located generally centrally located within zone 49. Zone 49 forms a margin around the inlet of ball passage 35 that is free of hardfacing.

Additional hardfacing in a variety of patterns may also be employed on the outer surface of bit leg 17, including placing hardfacing on substantially all of the outer surface of bit leg 17 but for zone 49 and possibly another zone (not shown) for a dimple for engagement by a fixture to hold head sections 13 in place while they are being welded to each other. In the example shown, an upward extending leading edge bead 51 is placed along the leading edge 43 of bit leg 17.

Also, one or more transverse beads 53 are located on the outer surface of bit leg 17 just above upper arcuate bead 47. Transverse beads 53 extend from leading edge bead 51 at upper arcuate bead 47 generally upward and to trailing edge 45. Preferably, transverse hardfacing beads 53 do not extend perpendicular to the longitudinal axis 55 of bit leg 17. at least in the vicinity of where the lower portion of bit leg 17 joins the upper body portion 16 (FIG.4) of head section 13. Rather each transverse hardfacing bead 53 is inclined at an acute angle relative to longitudinal axis 55. A cross-sectional plane 57 perpendicular to axis 55 at the junction of the lower portion of bit leg 17 with upper body portion 16 is shown by the dotted line in FIG. 4. This vicinity of cross-sectional plane 57 is subject to considerable stress when in a compressive load, and if hit leg 17 breaks, it is likely to break in the vicinity of plane 57. Any hardfacing beads extending generally parallel and close to cross-sectional plane 57 are not desired because of the possibility of causing stress cracks at the edges of the beads which could initiate a crack and lead to breakage of bit leg 17 iron the remaining upper body portion 16 of head section 13. The smooth curved beads 41, 47 that define zone 49 avoid creating stress cracks in the area of cross-sectional plane 57 because neither is a straight-line perpendicular to axis 55.

Preferably, the hardfacing is applied by a robotic device that flows powdered hardfacing materials through passages into an arc. The robotic device may be conventional as well as the composition of the hardfacing. Typically the hardfacing will comprise tungsten carbide granules within a matrix of steel, nickel, cobalt or alloys thereof. The tungsten carbide may be a variety of types and sizes such as sintered, cast or macrocrystalline.

The hardfacing pattern described herein particularly lends itself to automated hardfacing. The smooth curves above and below the ball inlet allow provide a hardfacing free zone for later insertion of locking balls and welding the plug. Avoiding straight-line hardfacing in the area above the ball plug and below the junction with the bit leg and bit body reduces the chances of leg breakage.

While the invention has been shown in only one of its forms, it should be apparent to those skilled in the art that it is no so limited, but is susceptible to various changes without departing from the scope of the invention.

The invention claimed is:

1. A rotary cone earth boring bit having at least one bit leg with a cone retaining ball passage that intersects an outer surface of the bit leg and is closed by a ball plug, the improvement comprising:

an upwardly curved lower hardfacing bead on the outer surface of the hit leg at least partially below the ball plug; and a downwardly curved upper hardfacing bead on the outer surface of the bit leg at least partially above the ball plug, the upper hardfacing bead having a leading end that curves downward and joins a leading portion of the lower hardfacing bead, the upper hardfacing bead having a trailing end that curves downward and joins a trailing portion of the lower hardfacing bead.

2. The bit according to claim 1. wherein the trailing end of the of the upper hardfacing bead joins the trailing portion of the lower hardfacing bead at a point that is lower on the bit leg than an uppermost point of the ball plug.

3. The bit according to claim 1, wherein the ball plug is free of any hardfacing.

4. The bit according to claim 1, wherein the upper and lower hardfacing beads define a generally elliptical completely closed perimeter surrounding the ball plug.

5. The bit according to claim 1, further comprising at least one transverse bead above the upper hardfacing bead and leading generally upwardly and circumferentially from a leading edge of the bit leg to a trailing edge of the bit leg.

6. The bit according to claim 1, wherein:

the outer surface of the bit leg has a central region above the ball plug and below a junction of the bit leg with a body of the bit, the central region extending from a leading edge to a trailing edge of the bit leg; and the central region is free of any hardfacing beads with straight portions extending perpendicular to a longitudinal axis of the bit leg.

7. An earth boring bit, comprising:

a bit body having a threaded upper end;

a plurality of bit legs depending downward from the bit body, each of the bit legs having a bearing pin;

a cone rotatably mounted on each bearing pin, each cone having cutting elements on its exterior;

a retaining ball passage extending from mating grooves on the bearing pin and the cone to an outer surface of each bit leg;

a ball plug closing the retaining ball passage on each of the bit legs, the ball plug having an exterior surface covered by a weld that welds the ball plug to the outer surface of each bit leg;

at least one ball plug bead of hardfacing that curves under, above and around each of the ball plugs, completely surrounding each of the ball plug and leaving the weld on the ball plug free of hardfacing.

8. The bit according to claim 7, wherein said at least one ball plug bead defines a generally elliptical-shaped perimeter completely surrounding the weld on each of the ball plugs.

9. The bit according to claim 7, wherein said at least one ball plug bead comprises an arcuate lower bead and an arcuate upper bead having leading and trailing ends that join the lower bead.

10. The bit according to claim 9, wherein the trailing end of the upper bead joins a trailing portion of the lower bead at a point that is lower on the bit leg than an uppermost Point of the ball plug.

11. The bit according to claim 7, further comprising at least one transverse bead on each of the bit legs above the ball plug, the transverse bead extending from a leading edge to a trailing edge of each of the bit legs, and being located above and in side-by-side contact with a leading portion of at least one ball plug bead, the transverse bead intersecting the leading edge at a point lower on the bit leg than on the trailing edge.

12. The bit according to claim 7, wherein a portion of said at least one ball plug bead extends along a leading edge of each of the bit legs and a portion of said at least one ball plug bead extends along a trailing edge of each of the bit legs.

13. A method of manufacturing an earth boring bit, comprising:

providing three head sections, each head section having a bit leg, a bearing pin extending from the bit leg, and a retaining ball passage extending from a groove on the bit leg to a ball inlet on an outer surface of the bit leg;

applying on each of the head sections an upward curved lower bead of hardfacing under the ball inlet and partially around the ball inlet and a downward curved upper bead of hardfacing above and at least partially around the ball inlet;

joining a leading end of the upper bead of hardfacing with a leading portion of the lower bead of hardfacing, and joining a trailing end of the upper bead of hardfacing with a trailing portion of the lower bead of hardfacing; then placing a cone on the bearing pin of each of the head sections and inserting balls into each of the ball passages to enter the grooves and lock the cones to the bearing pins; then inserting a ball retainer and plug into each of the ball passages and welding each of the plugs to the outer surface on one of the bit legs; then welding the head sections to each other.

14. The method according to claim 13, further comprising prior to placing the cone of the bearing pin of each of the head sections, applying a transverse bead of hardfacing from a point on a leading edge of each of the bit legs to a higher point on a trailing edge of each of the bit legs, and positioning a leading portion of the transverse bead above and in side-by-side contact with the leading portion of the upper bead of hardfacing.

15. The method according to claim 13, further comprising prior to placing the cone of the bearing pin of each of the head sections, applying a transverse bead of hardfacing from a point on a leading edge of each of the bit legs to a higher point on a trailing edge of each of the bit legs, and positioning the transverse bead above the upper bead of hardfacing.

16. The method according to claim 13, wherein the step of applying the upper and lower beads of hardfacing comprises joining the trailing end of the upper bead of hardfacing with the trailing portion of the lower bead of hardfacing at a point that is lower on the bit leg than an uppermost point of the ball inlet on each of the head sections.

* * * * *

UNITED STATES PATENT AND TRADEMARK OFFICE

CERTIFICATE OF CORRECTION

PATENT NO. : 7,891,443 B2
APPLICATION NO. : 12/032334
DATED : February 22, 2011
INVENTOR(S) : Alan J. Massey et al.

It is certified that error appears in the above-identified patent and that said Letters Patent is hereby corrected as shown below:

Column 3, line 62, delete “hit” and insert -- bit --

Claim 1, Column 4, line 31, delete “hit” and insert -- bit --
Claim 10, Column 5, line 21, delete “Point” and insert -- point --

Signed and Sealed this
Twenty-first Day of June, 2011

David J. Kappos

David J. Kappos
*Director of the United States Patent and Trademark Office*